United States Patent [19]

Kunzmann

[11] 4,084,631

[45] Apr. 18, 1978

[54] METHOD AND DEVICE FOR CONTROLLING A CASTING MACHINE

[75] Inventor: Konrad Kunzmann, Rollinghausen, Germany

[73] Assignee: Alfelder Machinen-und Modellfabrik Kunkel, Wagner & Co. KG, Alfeld, Leine, Germany

[21] Appl. No.: 590,634

[22] Filed: Jun. 26, 1975

[30] Foreign Application Priority Data

Jun. 27, 1974 Germany ..... 2430835

[51] Int. Cl.[2] ..... B22C 19/04; B22D 37/00

[52] U.S. Cl. ..... 164/4; 164/155; 164/337; 222/590

[58] Field of Search ..... 164/4, 335, 336, 337, 164/154, 155, 156, 157; 222/1, 56, 590, 594, 604

[56] References Cited

U.S. PATENT DOCUMENTS

| | | | |
|---|---|---|---|
| 2,753,605 | 7/1956 | Carleton | 164/155 |
| 2,882,567 | 4/1959 | Deakins | 164/4 UX |
| 2,905,989 | 9/1959 | Black | 164/155 |
| 3,319,728 | 5/1967 | Johansson | 164/155 X |
| 3,439,759 | 4/1969 | Rouanet | 222/56 X |
| 3,536,124 | 10/1970 | Hanas | 164/155 |
| 3,599,835 | 8/1971 | Kocks | 164/155 UX |
| 3,659,644 | 5/1972 | De Bie | 164/156 X |
| 3,773,218 | 11/1973 | Berthet | 222/590 |
| 3,818,971 | 6/1974 | Schutz | 164/4 |
| 3,856,182 | 12/1974 | Berthet | 164/155 X |
| 3,877,507 | 4/1975 | Hurter | 164/155 |
| 3,917,111 | 11/1975 | Berthet | 222/590 |

*Primary Examiner*—Francis S. Husar
*Assistant Examiner*—John S. Brown

[57] ABSTRACT

The weight of material in a pivotable casting ladle is continuously measured and the pivoting of the casting ladle is controlled in dependence thereon to maintain a constant head of material above the casting ladle output. The casting operation is terminated in dependence on a parameter such as time or weight associated with the casting being made.

The invention also includes a device suitable for carrying out this method.

12 Claims, 2 Drawing Figures

METHOD AND DEVICE FOR CONTROLLING A CASTING MACHINE

BACKGROUND OF THE INVENTION

The invention relates to a method and apparatus for controlling the casting of molded products and in particular to the control of automatic casting machines having a tilting casting ladle.

In automatic casting equipment, repeated difficulties occur in determining the amount of castable material such as molten metal or the like, required in order to provide a charge capable of completely and satisfactorily filling the mould. Different proposals have become known in order to eliminate these difficulties.

The simplest way of determining the amount has been by measuring the time during which the molten castable material is poured. This system fails, because the amount of material per unit time flowing out of the ladle is highly dependent on the height of the "bath level" (i.e. upper surface) of the molten material above the discharge gate of the ladle nozzle or spout. Rapid, intermittent tilting motions, which cannot be avoided with manual control, cause periodic fluctuations of the bath level. These fluctuations of the bath level lead to inaccuracies in metering the volume poured in any given time period. The temperature and the chemical and physical composition of the material also have influence on the amount of material flowing out of the ladle, per unit time. In addition, the opening of the nozzle spout or valve which is preferably formed of crystalline graphite becomes slightly larger in the course of even a single operating cycle.

In general, the three influences, aforementioned, can be easily compensated for, by correcting the time adjustment during which pouring takes place, since the casting temperature and the analysis of the material are, for technological reasons, subjected to rigorous premonitoring and therefore fluctuate during casting only within very narrow limits, and the change of the opening of the nozzle takes place very slowly. Any time correction which is necessary on account of this last influence, is only required at only larger, regular time intervals. On the other hand compensation for fluctuations caused by tilting errors, manual operation etc. cannot be so easily compensated for.

It is an object of the present invention to provide a method by which it is possible, in a simple and reliable manner, to determine the material quantity for every casting operation even in repeated cycles, with satisfactory accuracy without excessive material being lost and while insuring a complete filling of the moulds.

SUMMARY OF THE INVENTION

According to a first aspect of the invention, there is a method for controlling a casting machine having a pivotable casting ladle wherein the weight of the material in the casting ladle is continuously measured, and wherein the inclination of the casting ladle is adjusted by means of the weight measurement to maintain a constant head of material above the output nozzle of the casting ladle and controlling the termination of the casting operation by means of a parameter associated with the casting being made.

According to a second aspect of the invention, there is provided a device for controlling a casting machine having a pivotable casting ladle comprising weighing means for continuously weighing the pivotable casting ladle to determine the weight of material thereon. Control means are provided which is responsive to the weighing means for controlling the inclination of the pivotable casting ladle to maintain a constant head of material above the output of the casting ladle. Means are also provided for determining a parameter related to completion of a casting and means responsive to it for stopping the pouring of the material and the casting operation.

The invention proposes that the molten material which is ready for casting be allowed to flow through a calibrated nozzle opening to provide a uniform stream and, in so doing the weight change of the material capable of being cast, in the casting ladle is continuously measured and the inclination of the casting ladle is varied in a predetermined dependency thereon. That is to say, the column of castable material above the nozzle opening is kept constant during the entire casting operation, and the amount of material desired for casting need be regulated only with respect to the casting time.

By the pouring out the material, through a calibrated nozzle opening in conjunction with a constant control of the head of the liquid above this calibrated opening, an extremely high uniformity of the flow of castable material, into the mould is achieved. This high uniformity is the prerequisite, by which the proper determination of the desired casting amount can be regulated with respect to the duration of casting. What is important in this case is that due to the constant measurement of the weight and, dependent thereon, due to the continuous subsequent adjustment of the inclination of the casting ladle, a calm continuous movement of the casting ladle is ensured which substantially excludes all dynamic forces from having any influence on the casting operation. Thus a very sensitive control of the amount cast is obtained without it requiring any observation on the part of the operating personnel.

Advantageously, on reaching, a predetermined minimum weight of the castable material in the casting ladle, a controlled subsequent pouring operation may be initiated to refill the casting ladle. The subsequent refilling of the casting ladle, however, can also be effected at any time manually or by suitable automatic control. What has to be taken into account is merely the fact that the maximum permisible operating mounting weight of the casting ladle should not be exceeded. The refilling operation may be automatically interrupted on reaching the maximum weight during automatic subsequent filling. A warning signal may also be emitted in the case of manual refilling. Since this subsequent refilling operation can also be controlled by means of the weight measurement and by a constant backwards movement of the inclination of the casting ladle, any dynamic influence on the accuracy of the pouring and casting operation itself is substantially excluded. If the refilling of the casting ladle takes place in the state of rest, then the tilting angle is subsequently adjusted by means of a control curve programmed specially for the rest condition.

If the temperature and the composition of the liquid material and the size of the opening of the nozzle are excluded as influence values, then it is recommended to provide a combined control operation wherein the tilting angle of the casting ladle is controlled by means of a weighing machine such as an electronic weighing machine. The casting operation, however, is only interrupted if a specific predetermined weight has flowed out. The weight detection is preferably effected by an additional weighing machine, which directly weight the mould and the amount of material which has flowed into the mould. If desired, a further detection could be made by weighing the material as it flows through or into a secondary ladle arranged in front of the mould. In this exemplary variant, the subsequent refilling of the casting ladle once it has discharged a portion of the castable material into the pre-ladle is possible in the already described manner. It is also possible that the weighing machine controlling the angle of tilt, determines the amount of material which has flowed out by a relative difference in weight between the two ladles. The last method, however, does not permit the casting ladle to be subsequently filled during the casting operation by means of a refilling device.

The weighing device may be provided, situated between the carrier and the casting ladle, so that a continuous monitoring of the weight can be obtained. The weighing device may be adjustable with respect to a predetermined control program curve independence on the fixed weight. The program curve is predetermined as an integration of the weight-time and inclination parameters, and may be displayed in graphical or tactile form. The program curve may be sensed by a suitable conventional scanning element, which in turn provides an electrical control signal regulating the operation of a motor drive for tilting the ladle. The necessary dependency between the weight of the material in the ladle and the inclination of the ladle, to achieve a constant height in the liquid column above the calibrated nozzle opening can be fixed with satisfactory accuracy without difficulty in an empirical manner. In the case of a casting ladle which tapers downwards, the dependency between weight and inclination results in a paraboliclyshaped curve. On the other hand, an ellipse results as the curve in the case of a substantially cylindrical casting ladle.

The arrangement is also particularly suitable for the operation with a secondary or pre-ladle. Such a preladle is necessary if the material stream or jet flowing out of the ladle nozzle must always meet the same point of the mould surface, because, e.g., the pouring-in funnel is very small. The pre-ladle is filled with the help of an electronic or similar weighing machine with the desired amount of liquid material. The filling operation is effected in the tipped-up position of the pre-ladle. The pre-ladle is tipped over for emptying.

The calibrated opening of a nozzle also serves as the casting opening. Also, a subsequent refilling device can be associated with the casting ladle, which subsequent filling device can be controlled in dependence the ladle or its contents reaching a specified position of the control curve by the latter, (e.g. in a relatively large soaking furnace).

BRIEF DESCRIPTION OF THE DRAWINGS

The invention will now be described in greater detail, by way of example, with reference to the drawings in which.

DESCRIPTION OF THE PREFERRED EMBODIMENTS

Figure 1:
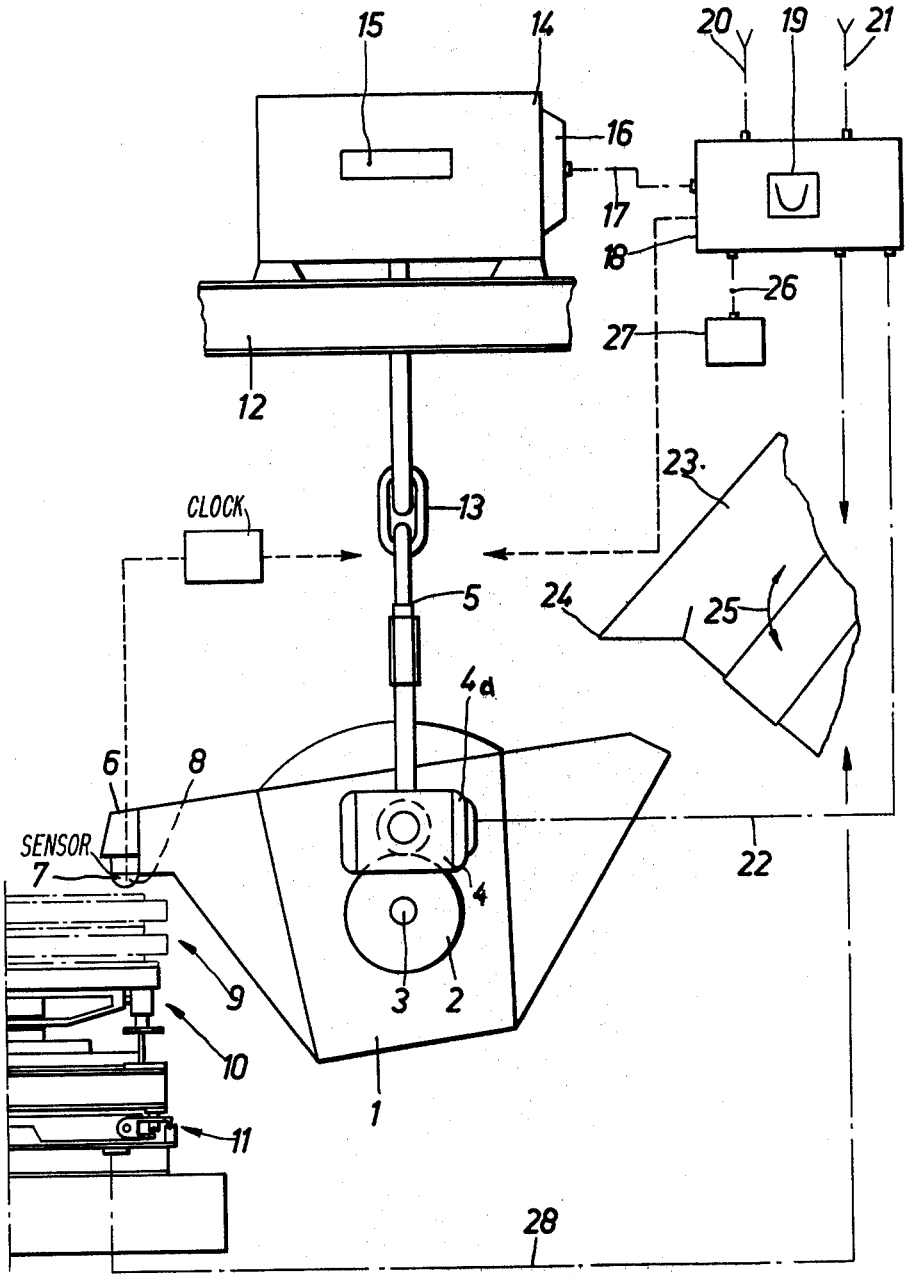
FIG. 1 is a side elevation view of an embodiment of the invention.

Referring to the drawings, in the embodiment shown in FIG. 1, the casting ladle is given the general reference numeral 1. This ladle is pivotally mounted on a shaft 3 to which a gearwheel 2 is fixed. The shaft and ladle is tiltable by actuation of a pinion 4 which is driven via a servomotor 4*a*. The shaft 3 and the motor 4 are secured to a stirrup-like suspension runner 5, which is suspended via a connection 13 at the load-supporting frame of an automatic, preferably electronic, weighing machine 14. The weight machine has an indicator part 15 and is mounted fixedly on a carrier rail 12 or on a movable travelling winch, car or the like. The weighing machine 14 can be of any known type of construction. The electronic control mechanism of the weighing machine is accommodated in a special housing which can be set up at any point removed from the injurious influences of the casting operation, e.g. even in a switching panel or station of an enclosed room.

The casting ladle 1, which tapers inwardly in the downwards direction in the example shown, may be closed by a cover on the top side. The ladle has a casting spout 6, which forms a closed channel and has a calibrated opening 8, which is constructed as a calibrated nozzle opening 7 from suitable ceronic, or the like material, e.g. of graphite.

The castable material is poured from the casting ladle 1, without a subsequently connected pre-ladle, directly into the moulds 9 which are supported on a casting buggy or hotmetal-ladle truck 10 which in this case is a separate part of the casing production line, which is itself arranged on an electronic weighing machine 11. The mould 9 is weighed directly by the electronic weighing machine 11 which is provided with means for switching off the casting operation when the mould has increased its weight by a specified amount.

Although not required, the example shows in association with the casting ladle 1 a refilling device 23 having a spout 24 which is pivotable in the arc indicated by the double arrow 25, in response to the reaching of a specified position in the control curve of the operating cycle as is described further below. If due to a fault of the mould 9, the material flows uncontrollably out of the mould, the specified weight increase of the mould 9 may not be achieved. Care can thus be taken that no damage is caused by the over-flow of the molten material by limiting the casting time to a maximal value. This time period should be as close as possible to the upper tolerance limit of the time necessary to complete the filling of the mould.

The output 16 of the electronic weighing machine 14 in connected to a control apparatus 18 via a line 17 which apparatus 18, may be remotely positioned. This control apparatus specifying the casting program contains means for storing or retaining the parameters necessary for cyclic operation of the system, preferably in the form of a graphical operational control program curve. The curve is schematically indicated at 19, and is as indicated determined in one of the many well known ways. The curve is so determined that it reproduces an accurate relationship between the weight determined by the weighing machine 14 and the appropriate inclination of the ladle. Through the weighing machine 14, a servo-metor or sensor (such as a selsyn motor) scans the control curve 19 producing simultaneously a control signal output. The control values resulting from the sensing of the control curve are transmitted via the line 22 to the motor drive 4*a* for the pivoting of the casting ladle so that the inclination of the casting ladle 1 is automatically and constantly varied during casting. The influence of dynamic forces on the casting operation is extensively reduced by the continuous variation of the inclination of the casting ladle 1. Rather, the control of the inclination in dependence on the weight, insures that, above the calibrated casting opening 8 of the nozzle brick 7, there is a predetermined liquid column, the height of which liquid column always remains constant. In this way it is ensured that the liquid material passes into the mould 9 out of the casting ladle 1 in a jet or stream of the highest uniformity. On the assumption that the composition and the temperature of the material are kept constant, the amount of material poured per unit time can be automatically determined. A time control device by which the minimum and maximum limits of pouring can be regulated may be associated with the nozzle as shown in FIG. 1. Such means may control a sensor detecting the flow of fluid through the nozzle and a clock providing elapsed time.

If, as in the example shown, the weight increase of the mould 9 is determined via the electronic weighing machine 11, then the electronic weighing machine 11 is also, as in the example shown, connected via the line 28 to the electronic control apparatus 18 in order to terminate the casting operation on reaching the desired weight.

If, as is shown in FIG. 1, there is associated with the casting ladle 1 a refilling device 23, then its pivoting drive (similar to the drive 4 and 4*a*, but not shown in FIG. 1) can be actuated via a control apparatus 27 which is connected via the line 26 likewise to the control apparatus 18. In this case the arrangement is so divised that, on reaching a specified minimum weight value for the casting ladle 1, the control apparatus triggers a subsequent pouring of material into the casting ladle 1. By the control also of this refilling operation it can be ensured that the dynamic forces occurring in this case can be reliable detected and cannot lead to any disturbance of the primary casting operation eminating from the calibrated opening 8 of the casting ladle. The refilling can be so controlled in respect to the casting fluid flowing from the ladle 1, that the set or predetermined inclination of the casting ladle 1 remains unaltered. That is a continuous refilling of the material occurs simultaneously with its casting. However, the refilling can also be performed so that the inclination of the casting ladle 1 varies as it is being refilled, particularly in such a manner that the inclination is reduced, i.e. the casting ladle executes a reverse pivoting movement during this time, while maintaining a constant head.

Different operating parameters may be fed via the input lines 20 and 21 to the control apparatus 18. As a result the control apparatus can react to additional influence factors, in order to control the casting operation. Thus, for example, a slag factor or a subsequent casting factor can be taken into account during the control. It is also possible, by this, to take into account any other dynamic forces which have not concomitantly been included in the control curve 19.

Figure 2:
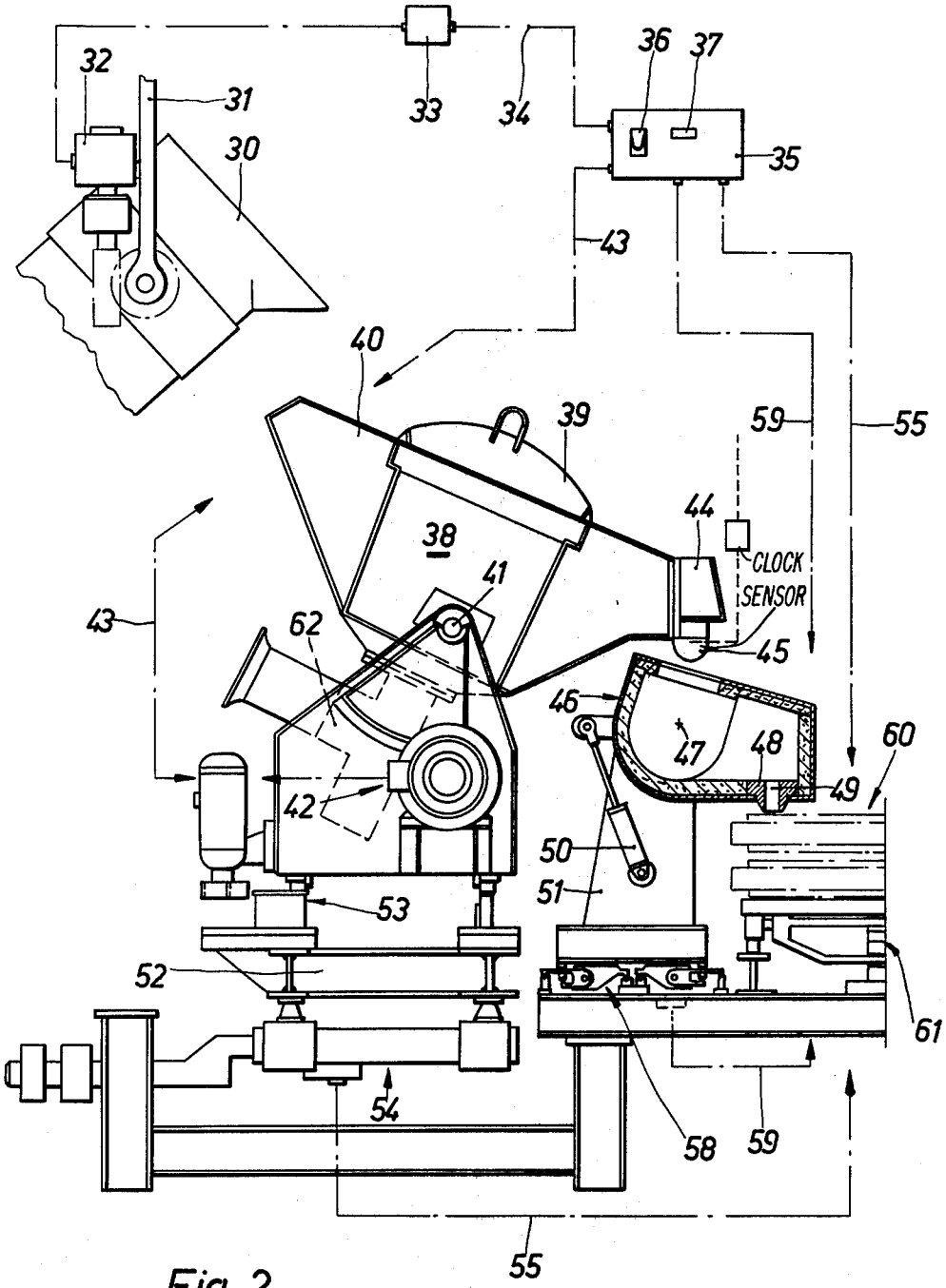
FIG. 2 is a similar view of a second embodiment of the invention.

In the case of the embodiment according to FIG. 2 an arrangement is shown in which the casting operation is effected via a secondary or pre-ladle. Such a pre-ladle is necessary if the outflowing casting stream always has to meet the same point of the mould surface, because, for example, the casting funnel is very small.

Also in the case of the embodiment according to FIG. 2 a refilling device 30 is provided which can be suspended by means of a suspension hanger 31, for example from a movable crane. The inclination of the refilling device 30 is determined by a servomoter 32 which is controlled via a control apparatus 33 which, in turn, is connected via a line 34 to the main control apparatus 35. The control apparatus 35 again has a fixed control curve 36 determining the casting operation. In the example shown, there is also provided on the control apparatus 36 at least one indicator 37 for one of the weighing machines.

In this embodiment, the casting ladle 38 is provided with a cover 39, a refilling inlet pipe 40 for the refilling device 30 and a casting spout 44, at the lower end of which is provided a pouring-out opening in the nozzle 45. The casting ladle 38 is pivotably mounted at 41 in a support which is movable on wheels 53 and is pivotable via a pivot drive 42. The latter is in turn connected via a line 43 to the control apparatus 35. The rails for the support are mounted on a frame 52, which in turn is supported on an electronic weighing machine 54. The electronic weighing machine 54 is connected to the control apparatus 35 via the line 55.

The material leaving the nozzle 45 of the casting ladle arrives in the pre-ladle 46, which is pivotably mounted at 47 on a carrying support 51. The pre-ladle has a nozzle 48 of suitable ceramic etc, having a predefined casting opening 49. A pivot drive 50 comprising a piston-cylinder, serves to pivot the pre-ladle. The carrying support 51 is in turn supported on a further electronic weighing machine 58 which is connected to the control apparatus 35 via the line 59. The material passes from the nozzle opening 49 of the pre-ladle in the mould 60, which is supported on a standing track truck 61.

The casting opening 49 of the pre-ladle is also calibrated. Generally, the pre-ladle 46 is extended longitudinally and movable along suitable rails so far that two moulds on the standing line can be cast one after the other without the standing line itself moving. If necessary, the pre-ladle can also be equipped with a separate heater, such as an electrical inductor drive for the purpose of raising the temperature or maintaining the temperature of the material in the ladle at a defined point.

In the case of this embodiment, it is not necessary to weigh the mould 60 during the casting operation in order to determine the weight increase due to the casting operation. Rather, the casting amount is determined by the electronic weighing machine 58, on which the pre-ladle is mounted.

In some cases in which a pre-ladle 46 can be dispensed with an in which a subsequent refilling device 30 is not provided, the electronic weighing machine 54 can be used both for the control of the inclination of the primary casting ladle 38 and for ending the casting operation via the control apparatus 35, since the electronic weighing machine 54 on which the primary casting ladle is mounted also determines the weight decrease of the casting ladle 38.

As inductive heating arrangement may be provided in association with the casting ladle 38 in FIG. 2.

The control can also be effected by means of a measurement of the outflow rate, that is to say by corresponding determination of the weight change per unit time.

The weighing devices, may be any conventional, mechanical scale with electrical or electronic readouts or strain gauges, stress gauges or the like.

It will be understood that the above description of the present invention is susceptible to various modification changes and adaptations; and is to be taken as illustrative only of the invention and not limiting of its scope.

What is claimed is:

1. Apparatus for controlling the casting of molten metal comprising a pivotable casting ladle for holding said molten metal and having an outlet for pouring said molten metal, control means having a predetermined program for controlling the inclination of said ladle to pour said molten metal, weighing means for continuously determining the weight of metal in said ladle and means responsive to said weighing means for modifying said predetermined program to cause said control means to vary the inclination of said ladle to maintain a constant head of metal above said outlet and including means for determining at least one parameter indicative of the end of a casting cycle and means for arresting the inclination of said ladle to stop the pouring of molten metal.

2. The apparatus according to claim 1, including means for refilling said ladle in dependence upon a predetermined position in said control program.

3. The apparatus according to claim 2, including means responsive to said weighing means for determining the weight of metal in said ladle to modify said predetermined program for initiating said refilling of said ladle on indication of the presence of a predetermined minimum amount of metal in said ladle.

4. The apparatus according to claim 3, including means for refilling said ladle simultaneously with varying the inclination thereof in response to the weighing of the ladle.

5. Apparatus for controlling the casting of molten metal comprising a pivotable casting ladle for holding said molten metal, said ladle having a nozzle defining a calibrated pouring outlet for the discharge of a uniform flow stream of molten metal, said pouring outlet being disposed to permit the retention of a head of molten metal above the nozzle in said ladle during the pivoting thereof, control means having a predetermined program for controlling the inclination of said ladle to pour said molten metal, weighing means for continuously determining the weight of metal in said ladle means responsive to said weighing means for modifying said predetermined program to cause said control means to vary the inclination of said ladle to maintain the head of metal above said outlet at a constant level and means for determining at least one parameter indicative of the end of a casting cycle and means for arresting the inclination of said ladle to stop the pouring of molten metal in response thereto.

6. The apparatus according to claim 5, including metering means associated with said nozzle to determine the flow of material therethrough.

7. The apparatus according to claim 6, wherein said metering means comprises a clock to determine the elapse of time during which metal flows through said nozzle.

8. The apparatus according to claim 5 including means for determining the time during which the molten metal is poured and wherein said predetermined program for the inclination of said ladle is responsive to means for integrating the time — weight ratio.

9. Apparatus for controlling the casting of molten metal comprising a pivotable casting ladle for holding said molten metal, said ladle having a nozzle defining a calibrated pouring outlet for the discharge of a uniform flow stream of molten metal, said pouring outlet being disposed to permit the retention of a head of molten metal above the nozzle in said ladle during the pivoting thereof, means comprising weighing means for measuring the weight of the cast being formed to determine the flow of metal therefrom control means having a predetermined program for controlling the inclination of said ladle to pour said molten metal, weighing means for continuously determining the weight of metal in said ladle, means responsive to said weighing means for modifying said predetermined program to cause said control means to vary the inclination of said ladle to maintain the head of metal above said outlet at a constant level and means for determining at least one parameter indicative of the end of a casting cycle and means for arresting the inclination of said ladle to stop the pouring of molten metal in response thereto.

10. Apparatus for controlling the casting of molten metal comprising a pivotable casting ladle for holding said molten metal and having an outlet for pouring said molten metal, control means having a predetermined program for controlling the inclination of said ladle to pour said molten metal, said predetermined program being in the form of a curve and said control means including means for sensing the path of said curve, weighing means for continuously determining the weight of metal in said ladle and means responsive to said weighing means for modifying said predetermined program to cause said control means to vary the inclination of said ladle to maintain a constant head of metal above said outlet and including means for determining at least one parameter indicative of the end of a casting cycle and means for arresting the inclination of said ladle to stop the pouring of molten metal.

11. A method for casting molten metal from a pivotable ladle having a pouring outlet comprising the steps of locating said outlet so that a head of molten metal is formed and maintained above it during pivoting and maintaining a uniform flow of molten metal through said outlet during pivoting of said ladle, controlling the inclination of said ladle in dependence upon a predetermined control program, to pour molten metal from said ladle, continuously weighing said ladle to determine the amount of metal therein, and adjusting the control program in response to said weighing to cause the inclination of said ladle to vary to maintain the head of molten metal above said outlet at a constant level and simultaneously determine at least one parameter indicative of the end of a casting cycle and thereafter arresting the inclination of the ladle to stop the pouring of said molten metal.

12. The method according to claim 11, including the steps of refilling said casting ladle upon the sensing of a predetermined weight of molten metal in said ladle, while simultaneously inclining said ladle to maintain the constant head above said outlet.

* * * * *